US008594908B2

(12) United States Patent
Yoshikawa et al.

(10) Patent No.: US 8,594,908 B2
(45) Date of Patent: Nov. 26, 2013

(54) INTAKE SYSTEM FOR INTERNAL COMBUSTION ENGINE

(75) Inventors: Takaya Yoshikawa, Kasugai (JP); Tomohiro Tajima, Kasugai (JP); Masao Tsuzuki, Kakamigahara (JP)

(73) Assignee: NGK Spark Plug Co., Ltd., Aichi (JP)

( * ) Notice: Subject to any disclaimer, the term of this patent is extended or adjusted under 35 U.S.C. 154(b) by 660 days.

(21) Appl. No.: 12/797,258

(22) Filed: Jun. 9, 2010

(65) Prior Publication Data

US 2010/0313863 A1 Dec. 16, 2010

(30) Foreign Application Priority Data

Jun. 15, 2009 (JP) ..... 2009-142033

(51) Int. Cl.
*F02B 47/08* (2006.01)
*F02M 25/07* (2006.01)

(52) U.S. Cl.
USPC ..... 701/108; 123/568.17; 73/114.74

(58) Field of Classification Search
USPC ..... 123/568.11, 568.17, 568.18, 568.19; 701/108; 73/114.31, 114.69, 114.71, 73/114.74
See application file for complete search history.

(56) References Cited

U.S. PATENT DOCUMENTS

| | | | | | |
|---|---|---|---|---|---|
| 4,705,009 | A * | 11/1987 | Asayama | 123/704 |
| 4,727,849 | A * | 3/1988 | Nishida et al. | 123/704 |
| 6,301,888 | B1 * | 10/2001 | Gray, Jr. | 60/605.2 |
| 6,470,682 | B2 * | 10/2002 | Gray, Jr. | 60/605.2 |
| 6,651,432 | B1 * | 11/2003 | Gray, Jr. | 60/605.2 |
| 7,047,741 | B2 * | 5/2006 | Gray, Jr. | 60/603 |
| 7,047,933 | B2 * | 5/2006 | Gray, Jr. | 123/305 |
| 7,267,117 | B2 * | 9/2007 | Tonetti et al. | 123/704 |
| 7,281,368 | B2 * | 10/2007 | Miyake et al. | 60/285 |
| 7,681,394 | B2 * | 3/2010 | Haugen | 60/603 |
| 8,036,812 | B2 * | 10/2011 | Vigild et al. | 701/103 |
| 2010/0199639 | A1 * | 8/2010 | Matsunaga et al. | 60/278 |
| 2012/0247439 | A1 * | 10/2012 | Ramappan et al. | 123/568.11 |

FOREIGN PATENT DOCUMENTS

| | | | |
|---|---|---|---|
| JP | 60-138264 | A | 7/1985 |
| JP | 63-63570 | U | 4/1988 |
| JP | 2008-261300 | A | 10/2008 |
| JP | 2011-21595 | * | 2/2011 |

* cited by examiner

*Primary Examiner* — Hai Huynh
(74) *Attorney, Agent, or Firm* — Sughrue Mion, PLLC

(57) ABSTRACT

An intake system for an internal combustion engine includes an intake passage connected with an intake port of the internal combustion engine; an EGR passage merged with the intake passage at a junction portion; a gas sensor attached to the intake passage and configured to detect a concentration of specific gas; and a control section configured to control the internal combustion engine on the basis of an output signal of the gas sensor. A diameter-enlarged portion having an inner diameter larger than an inner diameter of the junction portion is formed at a portion of the intake passage which is located on a downstream side of the junction portion. The gas sensor is located downstream from the diameter-enlarged portion.

5 Claims, 7 Drawing Sheets

INTAKE SYSTEM FOR INTERNAL COMBUSTION ENGINE

BACKGROUND OF THE INVENTION

The present invention relates to an intake system for an internal combustion engine such as a diesel engine or a gasoline engine.

An EGR (Exhaust Gas Recirculation) device is known in which a part of exhaust gas of an internal combustion engine such as diesel engine or gasoline engine is brought into an intake air and thereby a quantity of air which flows into the engine is reduced to lower a combustion temperature, in order to reduce a concentration of NOx within the exhaust gas and in order to improve a fuel economy. Moreover, a structure is known in which a turbocharger using exhaust gas is provided to the internal combustion engine and there are provided a low-pressure EGR passage for bringing a part of exhaust gas from a portion of exhaust passage located downstream beyond a turbine of the turbocharger back to the intake air, and a high-pressure EGR passage for bringing a part of exhaust gas from a portion of the exhaust passage located upstream beyond the turbine back to the intake air.

On the other hand, in the EGR device, a flow quantity (flow rate) of EGR gas (hereinafter, also referred to as "exhaust gas") included in a mixture gas of fresh air and exhaust gas needs to be adjusted by disposing various sensors at intake and exhaust passages and by monitoring a mixing state of the mixture gas by means of these sensors. Therefore, Japanese Patent Application Publication No. 2008-261300 (see paragraph [0014]) discloses a previously proposed EGR device. In this technique, for an engine having a turbocharger, an oxygen sensor is disposed downstream beyond a connecting (pipe-junction) portion between a low-pressure EGR passage and an intake passage, and thereby, flow quantities of low-pressure EGR passage and high-pressure EGR passage are controlled according to a concentration of $CO_2$ included in a mixture gas flowing within the intake passage. The document of Japanese Patent Application Publication No. 2008-261300 says that the fresh air is sufficiently mixed with the low-pressure EGR gas at a downstream location beyond the junction portion so as to form a mixture gas having a constant pressure, and that the $CO_2$ concentration included in this constant-pressure mixture gas can be accurately measured.

SUMMARY OF THE INVENTION

However, investigations of inventors of the present application have found that the exhaust gas is not sufficiently mixed with the fresh air at a downstream side beyond the junction portion in the case that the EGR pipe is simply connected with an intermediate portion of straight intake pipe. FIG. 10 shows a simulation result of the mixing state between the intake air (fresh air) which flows inside the intake passage 400 and the exhaust gas which is mixed with the intake air by flowing from the EGR passage 600 through the junction portion 400*c* into the intake passage 400, in the case that the EGR passage 600 is perpendicularly connected with an intermediate portion of intake passage 400 to form the junction portion 400*c*. In this simulation, the intake passage 400 is formed in a straight cylindrical (tubular) shape and has its inner diameter equal to 52 mm, and the EGR passage 600 is formed in a straight cylindrical (tubular) shape and has its inner diameter equal to the diameter of intake passage 400. Specifically, in this simulation, the fresh air (i.e., air which contains oxygen approximately at the rate of 20%) at atmospheric temperature is made to flow from an upstream side of intake passage 400 at a flow speed of 10 m/s, and also, the exhaust gas (gas which has an oxygen concentration equal to 0% because of an assumption that oxygen in air is completely burnt) at atmospheric temperature is made to flow from an upstream side of EGR passage 600 toward the junction portion 400*c* at a flow speed of 10 m/s. Thereby, the mixing states of fresh air and exhaust gas at respective locations are simulated by performing various hydrodynamic calculations. Then, a mixing ratio between fresh air and exhaust gas is determined from the oxygen concentration of mixture gas, at each predetermined location of intake passage 400 existing downstream from the junction portion 400*c*. In FIG. 10, a region F represents 80-100 wt % of fresh air, namely, the fresh air accounts for a rate falling within the range from 80% to 100% in weight in the region F. Moreover, a region Ex represents 80-100 wt % of exhaust gas, namely, the exhaust gas accounts for a rate falling within the range from 80% to 100% in weight in the region Ex. Moreover, a region Mix represents 40-60 wt % of fresh air, namely, the fresh air accounts for a rate falling within the range from 40% to 60% in weight in the region Mix. Furthermore, a region F-M located between the region F and the region Mix represents 60-80 wt % of fresh air, namely, the fresh air accounts for a rate falling within the range from 60% to 80% in weight in the region F-M. A region Ex-M located between the region Ex and the region Mix represents 60-80 wt % of exhaust gas, namely, the exhaust gas accounts for a rate falling within the range from 60° A) to 80% in weight in the region Ex-M. The region Mix is a region in which the fresh air and the exhaust gas have been mixed with each other approximately uniformly. On the other hand, the region F and the region Ex are regions in which the fresh air and the exhaust gas are almost not mixed with each other.

As shown in FIG. 10, each of the regions F and Ex exists near a wall surface of the intake passage 400 and is continues up to a downstream portion located far away from the junction portion 400*c*. In a case that a gas sensor 1*x* is disposed in these regions F and Ex, it can be understood that an almost not-mixed gas of fresh air or exhaust gas is measured.

Therefore, it is an object of the present invention to provide an intake system for an internal combustion engine, devised to sufficiently mix exhaust gas with fresh air on a downstream side of the junction portion between the intake passage and the EGR passage, thereby to accurately detect a concentration of specific gas included in the mixture gas of exhaust gas and fresh air by use of a gas sensor disposed in the mixture gas, and thereby to improve a performance of the internal combustion engine.

According to one aspect of the present invention, there is provided an intake system for an internal combustion engine, comprising: an intake passage connected with an intake port of the internal combustion engine; an EGR passage merged with the intake passage at a junction portion; a gas sensor attached to the intake passage and configured to detect a concentration of specific gas; and a control section configured to control the internal combustion engine on the basis of an output signal of the gas sensor, wherein a diameter-enlarged portion having an inner diameter larger than an inner diameter of the junction portion is formed at a portion of the intake passage which is located on a downstream side of the junction portion, wherein the gas sensor is located downstream from the diameter-enlarged portion.

According to another aspect of the present invention, there is provided an intake system for an internal combustion engine, comprising: an intake passage connected with an intake port of the internal combustion engine; an EGR passage merged with the intake passage at a junction portion; a gas sensor attached to the intake passage and configured to detect a concentration of specific gas; and a control section configured to control the internal combustion engine on the basis of an output signal of the gas sensor, wherein a bending portion bending without reducing its inner diameter as compared with an inner diameter of the junction portion is formed at a portion of the intake passage which is located on a downstream side of the junction portion, wherein the gas sensor is located downstream from the bending portion.

The other objects and features of this invention will become understood from the following description with reference to the accompanying drawings.

DETAILED DESCRIPTION OF THE INVENTION

Reference will hereinafter be made to the drawings in order to facilitate a better understanding of the present invention. Embodiments according to the present invention will be explained below.

Figure 1:
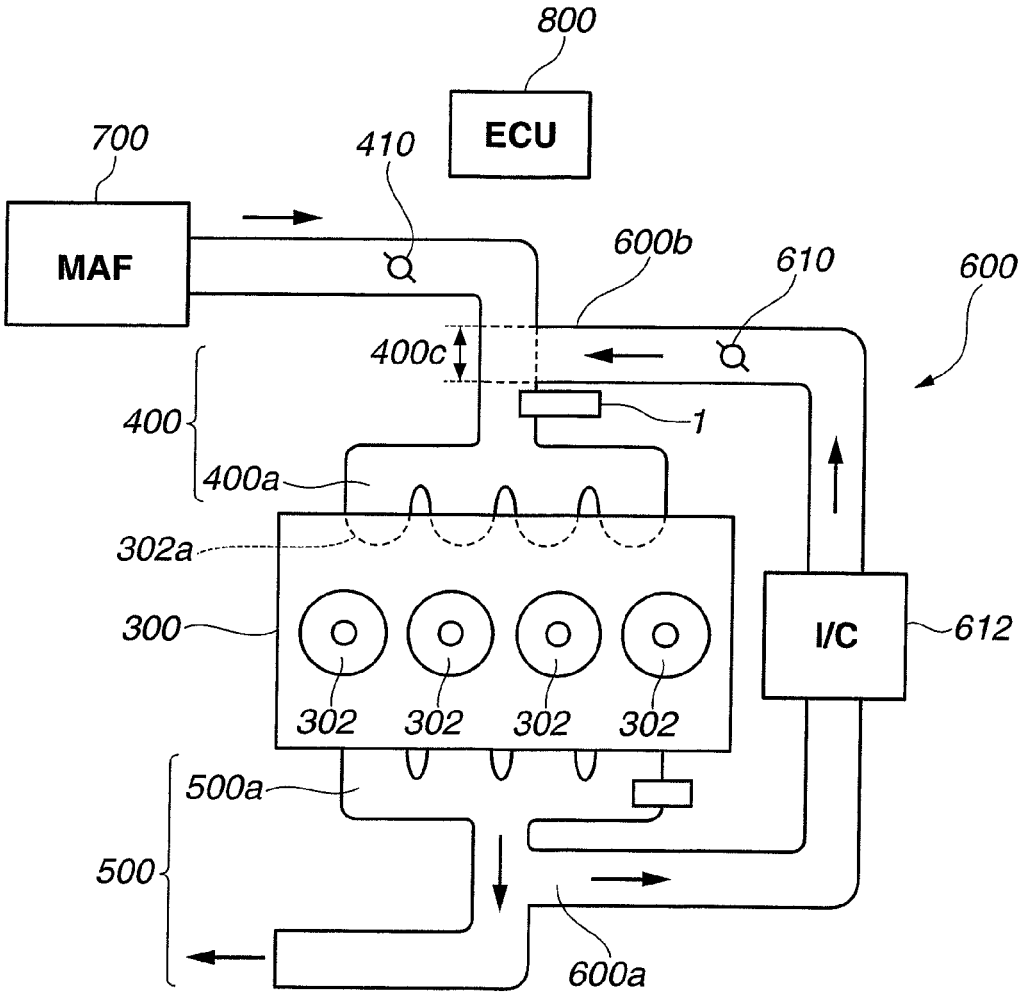
FIG. 1 is a view showing a schematic configuration of internal combustion engine equipped with an air intake system according to an embodiment of the present invention, and showing a schematic configuration of intake and exhaust channels.

FIG. 1 is a view showing a schematic configuration of internal combustion engine equipped with an intake system according to an embodiment of the present invention. The internal combustion engine 300 is a four-stroke cycle diesel engine which is of water-cooled-type and which includes four cylinders 302. The internal combustion engine 300 is connected with an intake passage 400 and an exhaust passage 500. The intake passage 400 is connected with intake ports 302*a* of the internal combustion engine 300. More specifically, a mass air flow (MAF) sensor 700 for detecting an amount (flow rate) of sucked fresh air (hereinafter, new air including no exhaust gas will be referred to as "fresh air") is connected to an upstream portion of intake passage 400. On the other hand, an end of the intake passage 400 forms an intake manifold 400*a*. The intake manifold 400*a* branches and is connected with respective intake ports 302*a* of cylinders 302. In the same manner, an upstream side of the exhaust passage 500 forms an exhaust manifold 500*a*. The exhaust manifold 500*a* branches and is connected with respective exhaust ports (not shown) of cylinders 302. Moreover, a downstream portion of the exhaust passage 500 is connected with an exhaust purification device, a muffler device and the like (not shown).

One end 600*a* of an EGR passage 600 is merged (connected) with a portion of exhaust passage 500 which is located downstream from the exhaust manifold 500*a*, and another end 600*b* of the EGR passage 600 is merged with a portion of intake passage 400 which is located upstream from the intake manifold 400*a*. Thus, a part of exhaust gas flowing within the exhaust passage 500 is returned (re-circulated) through the EGR passage 600 to the intake passage 400. Moreover, an intercooler (I/C) 612 for cooling exhaust gas by performing a heat exchange between the exhaust gas and an outside air is provided at an intermediate portion of EGR passage 600. A throttle valve 610 for adjusting a flow quantity (flow rate) of exhaust gas flowing through the EGR passage 600 is provided inside a portion of EGR passage 600 which is located on a downstream beyond the intercooler 612 (i.e., which is located in a side of another end 600*b* beyond the intercooler 612).

The another end 600*b* of EGR passage 600 is merged or connected with an intermediate portion of intake passage 400 to form a junction portion (connecting portion) 400*c* of intake passage 400. A throttle valve 410 for adjusting a flow quantity (rate) of intake air flowing through the intake passage 400 is provided inside a portion of intake passage 400 which is located upstream beyond the junction portion 400*c*. Moreover, a gas sensor 1 (which will be explained later in detail) is provided in a portion of intake passage 400 which is located downstream from the junction portion 400*c*. As mentioned later, the gas sensor 1 is shaped so as to be held by a mounting metal body 2 for mounting a gas sensor element including a sensing portion in the tubular intake passage 400. By screwing a male thread of outer surface of gas sensor 1 into a female thread cut in the wall of intake passage 400, the sensing portion of front end of gas sensor 1 protrudes into the intake passage 400.

According to this embodiment, (a compressor of) a turbocharger configured to work by means of exhaust gas may be provided at an intermediate portion of the intake passage 400 or the exhaust passage 500.

Moreover, an ECU (electrical control unit) 800 for controlling the internal combustion engine 300 is provided as shown in FIG. 1. It is noted that this ECU 800 corresponds to "control section or means" according to the present invention. The ECU 800 controls an operating state of internal combustion engine 300 in accordance with a request of driver and operating requirements of internal combustion engine 300. The ECU 800 is connected through electric wiring to various sensors including the gas sensor 1, and receives output signals of these various sensors. Moreover, the ECU 800 is connected through electric wiring to the throttle valves 410 and 610, and controls openings of the throttle valves 410 and 610.

Specifically, the ECU 800 controls at least one of the openings of throttle valves 410 and 610 on the basis of an output signal of concentration of specific gas component which is derived from the gas sensor 1, so that an oxygen concentration of mixture gas which is mixed by the intake passage 400 and the EGR passage 600 is optimized and then introduced to the internal combustion engine 300. Thereby, an engine performance and a fuel economy are improved, and an exhaust emission is reduced.

According to the present invention, the internal combustion engine 300 is controlled by detecting the concentration of specific gas component on an intake side. Therefore, the internal combustion engine 300 can be controlled more accurately as compared with a case where the concentration of specific gas component included in exhaust gas is detected by the gas sensor 1 provided on an exhaust side. This is because the control according to the concentration of specific gas component existing on the intake side can be done before a combustion of engine, whereas the control according to the concentration of specific gas component existing on the exhaust side is a feedback control.

Next, a structure of the gas sensor (oxygen sensor) 1 will now be explained.

Normally, the specific gas component which is measured by the gas sensor 1 is oxygen. The $O_2$ concentration included in the mixture gas which is introduced to the internal combustion engine 300 is calculated based on $O_2$ concentration value measured by the gas sensor 1. In the case that oxygen is measured as the specific gas component, a later-mentioned oxygen sensor (λ sensor) or an air-fuel ratio sensor can be used as the gas sensor 1.

Figure 7:
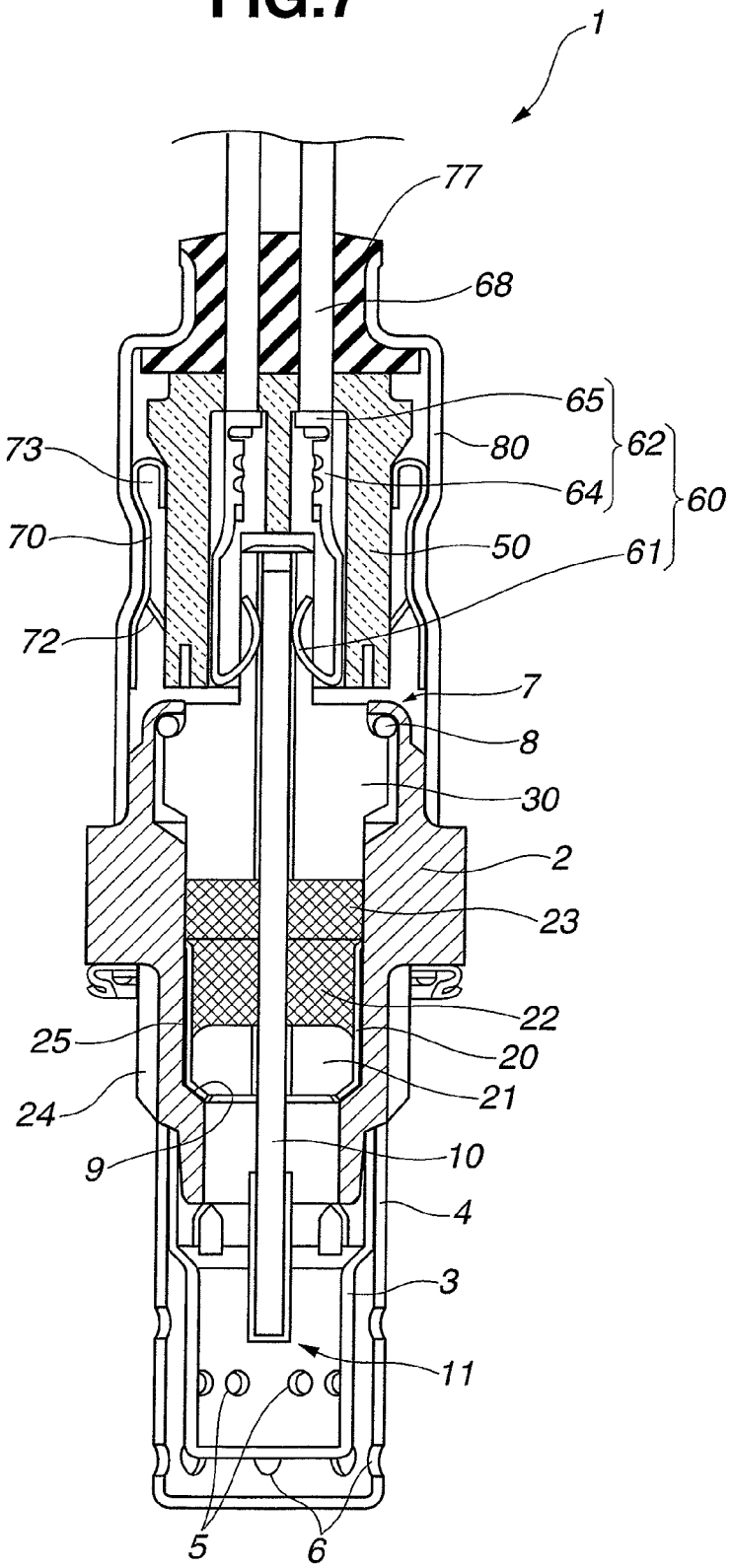
FIG. 7 is a cross sectional view of gas sensor (oxygen sensor), taken along a longitudinal direction of the gas sensor.

FIG. 7 is a cross sectional view of the gas sensor (oxygen sensor) 1, taken along a longitudinal direction of the gas sensor 1. Hereinafter, a lower side (lower direction) in FIG. 7 is referred to as "front side (front direction)" of the gas sensor 1, and an upper side (upper direction) in FIG. 7 is referred to as "rear side (rear direction)" of the gas sensor 1.

The gas sensor 1 is an assembly in which the gas sensor element 10 for detecting oxygen concentration is installed. The gas sensor 1 includes the gas sensor element 10 formed in a plate shape extending in an axial direction of gas sensor 1, the mounting metal body 2 formed in a shape of cylindrical tube, a ceramic sleeve 30 formed in a shape of cylindrical tube, a separator 50 formed of alumina, a grommet 77 formed of fluoro-rubber, and an outer tube 80 formed of stainless steel. A thread portion 24 for fixing the mounting metal body 2 to the exhaust pipe is formed in an outer surface of mounting metal body 2. The ceramic sleeve 30 includes an insertion (through-) hole for the gas sensor element 10, and is disposed inside the mounting metal body 2. The separator 50 is formed in a shape of cylindrical tube. Metal terminals 60 connected with electrode terminals 120*a*, 120*b* and 211 (see FIG. 8) provided at a rear end of gas sensor element 10 are inserted into the separator 50. The grommet 77 is formed in a shape of cylindrical tube, and is disposed on a rear end of separator 50. Four lead wires 68 (only two wires are shown in FIG. 1) connected with the metal terminals 60 are passed through the grommet 77. The outer tube 80 is formed in a shape of cylindrical tube, and holds or supports the separator 50 and the grommet 77 from an outside thereof. The outer tube 80 is connected with a rear end of the mounting metal body 2.

The mounting metal body 2 includes a through-hole 25 that passes through the mounting metal body 2 in the axial direction. Moreover, the mounting metal body 2 includes a stepped portion 9 protruding in a radially inner direction of the through-hole 25. This stepped portion 9 is formed by a conically tapered surface inclined from a plane perpendicular to the axial direction. That is, this tapered surface is formed to cause a diameter of front side of stepped portion 9 to be smaller than a diameter of rear side of the stepped portion 9. The mounting metal body 2 holds the gas sensor element 10 under a state where the sensing portion 11 of gas sensor element 10 is disposed outside the through-hole 25 in the front direction. That is, the sensing portion 11 projects from a front end of through-hole 25 in the axial direction. Inside the through-hole 25 of mounting metal body 2, a ceramic holder 21, powder-filled layers (talc rings) 22 and 23, and the above-mentioned ceramic sleeve 30 are arranged or laminated in this order from a front side toward a rear side of through-hole 25. Each of these ceramic holder 21, powder-filled layers 22 and 23, and ceramic sleeve 30 is annularly disposed at a radially-outer area of the gas sensor element 10, namely surrounds an outer circumferential surface of gas sensor element 10. Moreover, a swage packing 8 is disposed between the ceramic sleeve 30 and a rear end portion of the mounting metal body 2. A metal holder 20 for holding the talc ring 22 and the ceramic holder 21 and for maintaining air tightness is disposed between the ceramic holder 21 and the stepped portion 9 of the mounting metal body 2. The rear end portion of the mounting metal body 2 is swaged so as to press the ceramic sleeve 30 through the swage packing 8 in the front direction. Thereby, a swaged portion 7 is formed. By this swaging process, the talc rings 22 and 23 are compressed so that the gas sensor element 10 is fastened at a predetermined location in the mounting metal body 2.

On the other hand, as shown in FIG. 7, an outer protector 4 and an inner protector 3 are attached to an outer circumference of front-end side of the mounting metal body 2 by welding or the like. Each of these two protectors 3 and 4 is formed of a metal such as stainless steel, and includes a plurality of hole portions 5 and 6. These inner and outer protectors 3 and 4 cover the sensing portion 11 of gas sensor element 10.

The outer tube 80 is fixed to an outer circumference of rear-end side of the mounting metal body 2. The outer tube 80 holds the separator 50 and the grommet 77 from their radially outer sides, and the grommet 77 is fastened by swaging a rear end portion of outer tube 80. A metal holding member 70 is interposed between the separator 50 and the outer tube 80. The metal holding member 70 is formed approximately in a shape of cylindrical tube. The metal holding member 70 is formed with a projecting (convex) portion 72 that projects or overhangs in the radially inner direction, at a middle portion of metal holding member 70. Namely, the projecting portion 72 projects from axially middle portions of inner and outer circumferential surfaces of metal holding member 70 toward the inner side of gas sensor 1. A rear end of the metal holding member 70 is folded back in the radially inner direction to form a folded portion 73. Since the folded portion 73 and the convex portion 72 are elastically in contact with an outer circumferential surface of the separator 50, the separator 50 is held in the outer tube 80.

Each metal terminal 60 includes a base portion 62 which is connected with the lead wire 68 by swaging, and a front (tip) portion 61 which is extended from the base portion 62 and folded back in the radially inner direction. The base portion 62 includes a first swaged portion 65 and a second swaged portion 64. The first swaged portion 65 sandwiching an outer circumference of insulating coating of lead wire 68 is swaged to fasten the lead wire 68. The second swaged portion 64 and a copper wire exposed by stripping an front end of lead wire 68 are swaged to establish an electric connection between the lead wire 68 and the second swaged portion 64. Moreover, the plurality of front portions 61 are arranged to cause those inwardly folded portions to respectively face the electrode terminals 120*a*, 120*b* and 211 formed on two-side surfaces of rear end of gas sensor element 10. Since the plurality of front portions 61 are positioned to be opposed to each other through the gas sensor element 10, the electrode terminals 120*a*, 120*b* and 211 are interposed between the folded portions of front portions 61. Hence, by a spring force of front portions 61, the front portions 61 are biased to the electrode terminals 120*a*, 120*b* and 211 so that the metal terminals 60 are electrically connected with the electrode terminals 120*a*, 120*b* and 211.

Figure 8:
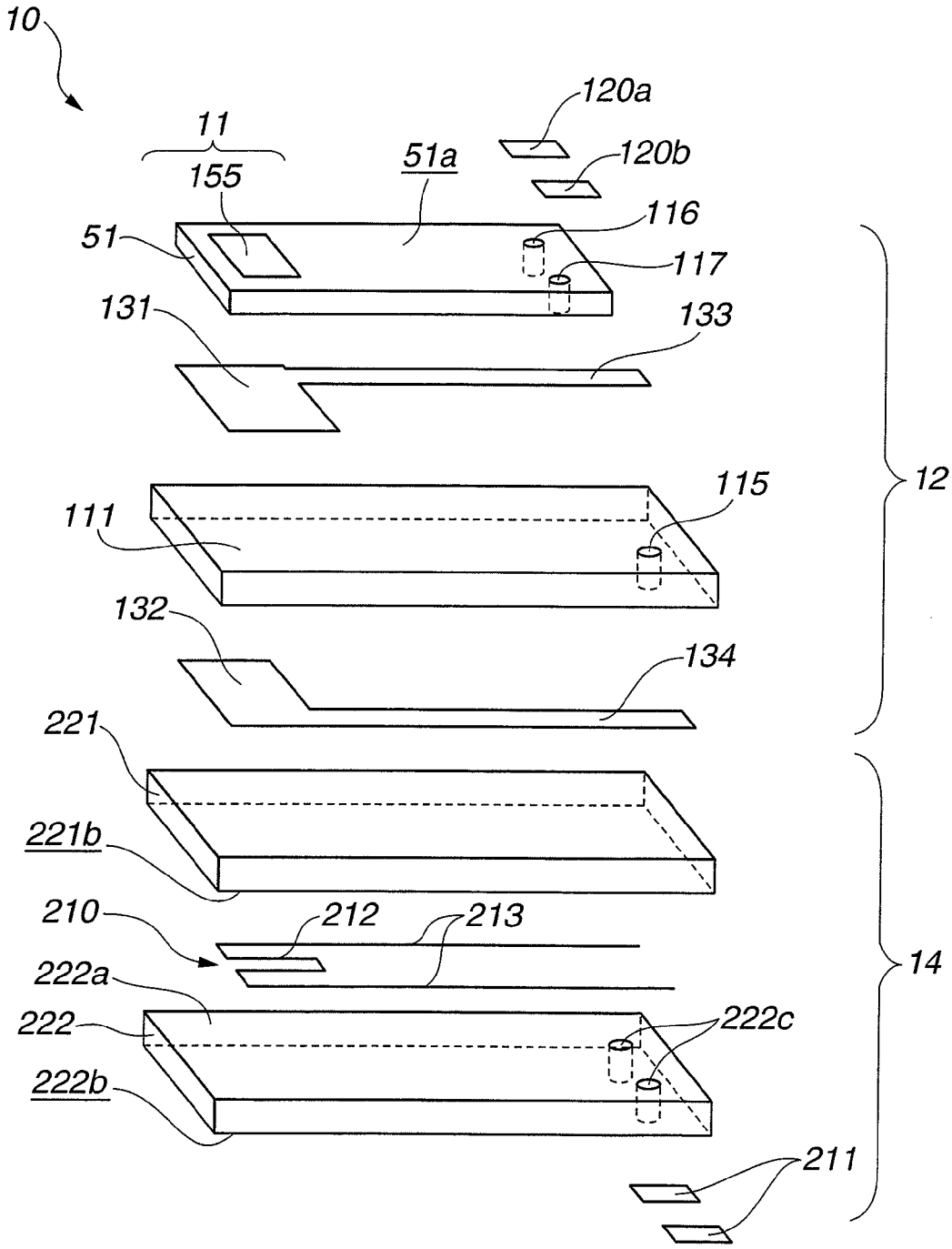
FIG. 8 is a developed view showing a structure of sensor element portion.

Next, a structure of the gas sensor element 10 will now be explained referring to a developed view of FIG. 8. The gas sensor element 10 is formed in a long plate shape. The gas sensor element 10 includes an oxygen concentration cell 12 for sensing oxygen concentration of exhaust gas, and a heater 14. That is, the gas sensor element 10 is a laminate of the oxygen concentration cell 12 and the heater 14. The oxygen concentration cell 12 includes a solid electrolyte layer 111, a sensing electrode 131, and a reference electrode 132. The sensing electrode 131 is formed in a rectangular shape, and is provided at a left side of upper surface of the solid electrolyte layer 111 in FIG. 8. The reference electrode 132 functions as a counter electrode to the sensing electrode 131, and faces the sensing electrode 131 through the solid electrolyte layer 111. Moreover, a sensing lead portion 133 extends from the sensing electrode 131 in the longitudinal (right direction of FIG. 8) direction. In the same manner, a reference lead portion 134 extends from the reference electrode 132 in the longitudinal (right direction of FIG. 8) direction.

A surface of the sensing electrode 131 is coated with a porous protective layer 155 that protects the sensing electrode 131. An insulating layer 51 for protecting the lead portion 133 is formed on the solid electrolyte layer 111, and surrounds the porous protective layer 155. The sensing portion 11 is defined by a laminated portion (body) which includes the sensing electrode 131 and the reference electrode 132 and the like and which is located at the front end of gas sensor element 10. An end portion of the reference lead portion 134 is electrically connected with the electrode terminal 120*b* provided at a right end of upper surface 51*a* of the insulating layer 51 (as viewed in FIG. 8), through a through-hole 115 formed in the solid electrolyte layer 111 and a through-hole 117 formed in the insulating layer 51. On the other hand, an end portion of the sensing lead portion 133 is electrically connected with the electrode terminal 120*a* provided at the right end of upper surface 51*a* of the insulating layer 51, through a through-hole 116 formed in the insulating layer 51.

On the other hand, the heater 14 includes insulating layers 221 and 222, and a heating resistor member 210 which are laminated. The heating resistor member 210 is interposed between a lower surface 221*b* of the insulating layer 221 and an upper surface 222*a* of the insulating layer 222, and extends in the longitudinal direction. The heating resistor member 210 includes a heating portion 212 in which a heating wire is arranged in a snaking shape, and a pair of heating lead portions 213 which extend from an end portion of heating portion 212 in the longitudinal direction. The heating portion 212 is located directly under the sensing electrode 131. Each heating lead portion 213 is connected through a through-hole 222*c* of the insulating layer 222 with the electrode terminal (electrode pad) 211 formed on a lower surface 222*b* of the insulating layer 222.

For example, the solid electrolyte layer 111 can be made by using partially-stabilized zirconia (admixture obtained by adding yttria or calcia as stabilizer, to zirconia). The insulating layers 51, 221 and 222 can be made by using alumina as its main component. The sensing electrode 131, the reference electrode 132 and the heating portion 212 can be made by using, for example, platinum Pt, rhodium Rh, palladium Pd. However, the platinum P is preferable, because each of the electrodes 131 and 132 needs to have predetermined characteristics as an electrode and because the heating portion 212 reaches a high temperature by passing electric-current. The porous protective layer 155 can be made by using, for example, an admixture which is obtained by mixing an alumina (main component) with a sublimation material such as carbon. This carbon sublimates by a burning so that the porous protective layer 155 is formed.

Figure 2:
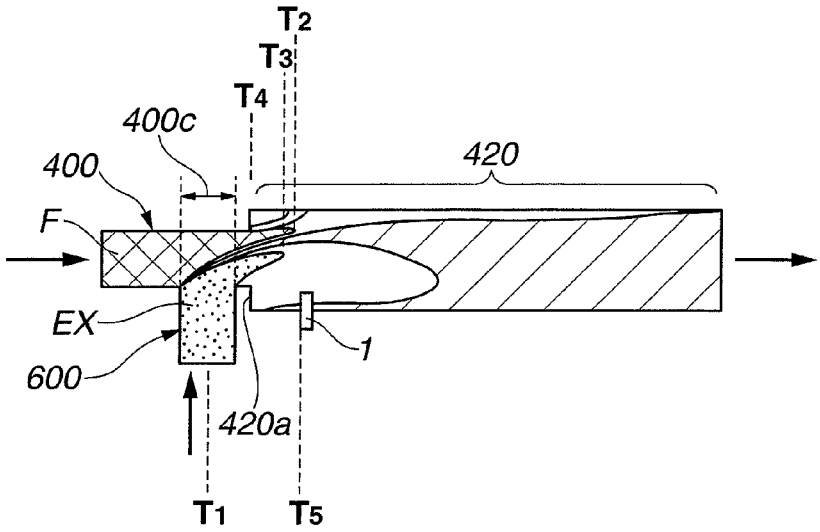
FIG. 2 is a view showing a mixing state of mixture gas in a case that a diameter-enlarged portion is formed at a portion of intake passage which is located downstream beyond a junction portion with an EGR passage.

Next, a shape of the intake passage 400 located downstream from the junction portion 400*c* will now be explained referring to FIGS. 2 to 4. As mentioned above, in the case that the EGR passage 600 is simply connected with an intermediate portion of straight intake passage 400, the exhaust gas is not sufficiently mixed with the fresh air downstream from the junction portion 400*c*. Therefore, as shown in FIG. 2, a diameter-enlarged portion 420 having an inner diameter larger than that of junction portion 400*c* (i.e., than an inner diameter of a portion of intake passage 400 which is located upstream from the junction portion 400*c*) is formed at a portion of intake passage 400 which is located on a downstream side of the junction portion 400*c*. In this case, it has been found that the exhaust gas is sufficiently mixed with the fresh air also near an upstream end 420*a* (a connecting portion with the junction portion 400*c*) of the diameter-enlarged portion 420. As a reason for this, it is considered that a swirl occurs since a cross-sectional area of intake passage 400 increases (almost triplication in this embodiment) at a downstream side beyond the junction portion 400*c*. Hence, by attaching the gas sensor 1 to the diameter-enlarged portion 420 of intake passage 400 or to a downstream portion beyond the diameter-enlarged portion 420, the concentration of specific gas component included in the mixture gas which has been generated by a sufficient mixing of exhaust gas and fresh air can be accurately measured.

Moreover, it is preferable that a distance between the upstream end 420*a* (a location point $T_4$ in FIG. 2) of diameter-enlarged portion 420 and a center point (a location point $T_1$ in FIG. 2) between upstream and downstream ends of junction portion 400*c* is smaller than or equal to 510 mm. That is, it is preferable that the distance between the locations $T_4$ and $T_1$ along the intake-passage axial direction is smaller than or equal to 510 mm. In the case of this range, the fresh air which flows within the intake passage 400 and the exhaust gas which flows from the EGR passage 600 through the junction portion 400*c* into the intake passage 400 can be rapidly introduced to the diameter-enlarged portion 420. Accordingly, the gas sensor 1 can be mounted at a location closer to the junction portion 400*c*. That is, an attachment point (a location point $T_5$ in FIG. 2) for the gas sensor 1 can be brought closer to the junction portion 400*c*. In this embodiment, the distance between the location points $T_1$ and $T_4$ is equal to 40 mm.

Figure 10:
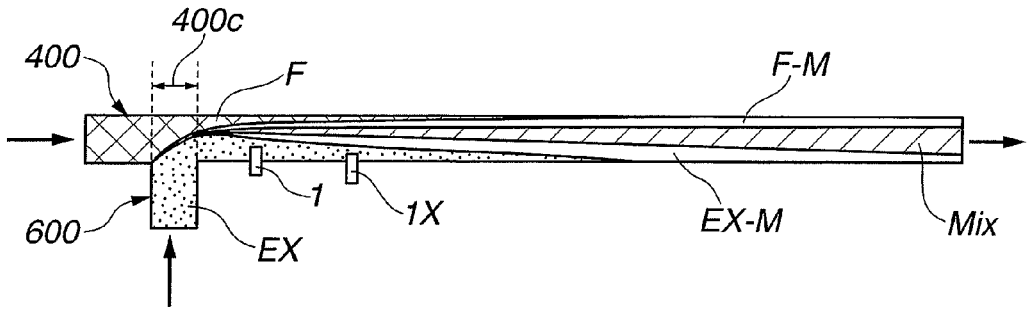
FIG. 10 is a view showing a mixing state of mixture gas in a case that the inner diameter of intake passage is constant on a downstream side beyond the junction portion.

FIG. 2 shows a simulation result conducted under a condition identical with that of FIG. 10. In the case of FIG. 2, the inner diameter of diameter-enlarged portion 420 is equal to 90 mm, and the diameter-enlarged portion 420 is connected to the downstream side of junction portion 400*c*. Moreover, all portions of intake passage 400 except the diameter-enlarged portion 420 have an uniform magnitude of inner diameter (equal to 52 mm). Also the junction portion 400*c* has the uniform inner diameter equal to 52 mm.

It is preferable that the inner diameter of diameter-enlarged portion 420 is smaller than or equal to one quarter of diagonal-line length of an engine room in which the intake passage 400 is disposed. If the inner diameter of diameter-enlarged portion 420 exceeds one quarter of diagonal-line length of the engine room, it becomes difficult to mount the diameter-enlarged portion 420 in the engine vehicle. Moreover, it is preferable that the inner diameter of junction portion 400*c* falls within a range from 20 mm to one fifth of the diagonal-line length of engine room. If the inner diameter of junction portion 400*c* is smaller than 20 mm, it is difficult to introduce the fresh gas or the exhaust gas. On the other hand, if the inner diameter of junction portion 400*c* is greater than one fifth of the diagonal-line length of engine room, it is difficult to mount the junction portion 400*c* and the intake and EGR passages 400 and 600 connected with the junction portion 400*c*, in the vehicle. Moreover, it is preferable that a longitudinal length of diameter-enlarged portion 420 is smaller than or equal to the diagonal-line length of engine room. If the length of diameter-enlarged portion 420 is greater than the diagonal-line length of engine room, it is difficult to mount the diameter-enlarged portion 420 in the vehicle.

It is noted that the phrase "the gas sensor 1 is disposed (located) downstream from the diameter-enlarged portion 420" includes a feature "the gas sensor 1 is disposed to (located in) the diameter-enlarged portion 420" as shown in FIG. 2.

Figure 3:
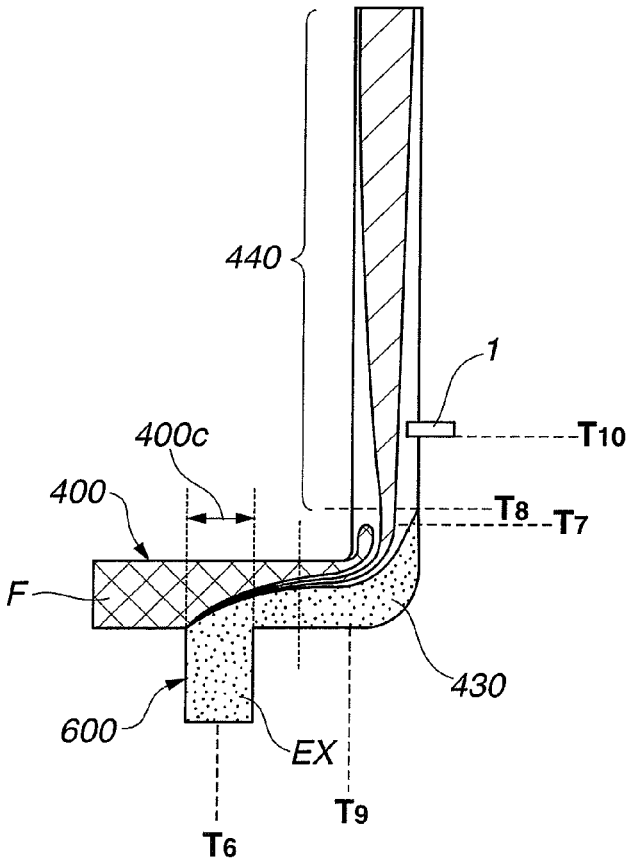
FIG. 3 is a view showing a mixing state of mixture gas in a case that a bending portion is formed at a portion of intake passage which is located downstream beyond the junction portion.

As shown in FIG. 3, as another case, a bending portion 430 which bends without reducing its inner diameter as compared with the inner diameter of junction portion 400*c* is formed at a portion of intake passage 400 which is located on a downstream side of the junction portion 400*c*. That is, in this embodiment, the bending portion 430 is formed so as to bend a portion of intake passage 400 which is located downstream beyond the junction portion 400*c* while maintaining the uniform diameter of intake passage 400. Then, the gas sensor 1 is attached to a portion of intake passage 400 which is located downstream from the bending portion 430. In this case, it has been found that the exhaust gas is sufficiently mixed with the fresh air in a portion located downstream from the bending portion 430. As a reason for this, it is considered that a swirl occurs in the bending portion 430.

Moreover, it is preferable that a distance between an upstream end (a location point $T_9$ in FIG. 3) of bending portion 430 and a center point (a location point $T_6$ in FIG. 3) between upstream and downstream ends of junction portion 400*c* is smaller than or equal to 510 mm. In the case of this range, the fresh air which flows within the intake passage 400 and the exhaust gas which flows from the EGR passage 600 through the junction portion 400*c* into the intake passage 400 can be quickly introduced to the bending portion 430. Accordingly, the gas sensor 1 can be mounted at a location closer to the junction portion 400*c*. That is, an attachment point (a location point $T_{10}$ in FIG. 3) for the gas sensor 1 can be brought closer to the junction portion 400*c*. In this embodiment, the distance between the locations $T_6$ and $T_9$ is equal to 100 mm.

FIG. 3 shows a simulation result conducted under a condition identical with that of FIG. 10. In the case of FIG. 3, the intake passage 400 is bent at a right angle without changing the diameter of intake passage 400 (=52 mm), at a downstream location beyond the junction portion 400*c*. It is noted that "bending portion 430" is defined by a range of intake passage 400 over which an axis of intake passage 400 continues to bend at a predetermined curvature. Moreover, it is noted that the phrase of "the gas sensor 1 is disposed (located) downstream from the bending portion 430" means not only a structure in which the gas sensor 1 is disposed in (located at) a straight portion 440 extending after the bending portion 430 (straight portion 440 extending from a location at which the bending of bending portion 430 ends) as shown in FIG. 3, but also a structure in which the gas sensor 1 is disposed in (located at) the bending portion 430. Moreover, it is noted that the phrase of "without reducing the diameter" includes a case where the diameter is reduced so as not to become smaller than 90% in magnitude of the inner diameter of junction portion 400*c*, because such a diameter reduction does not damage a gas-mixing effect of the bending portion 430. However, in the case that a bypass pathway or a branch pathway having a small diameter is provided to a portion of intake passage 400 which is located downstream beyond the junction portion 400*c*, such a pathway having the small inner diameter produces a poor gas-mixing effect. Hence, the bypass pathway or branch pathway in this case does not correspond to "the bending portion 430" according to the present invention.

According to the present invention, both of a diameter-enlarged portion which has an inner diameter larger than that of junction portion 400*c* and a bending portion which bends from the junction portion 400*c* may be formed at a portion of intake passage 400 which is located downstream beyond the junction portion 400*c*. Then, the gas sensor 1 may be disposed within a portion of intake passage 400 which is located downstream from both of the diameter-enlarged portion and bending portion. Such a structure includes the following three cases (1) to (3). Namely, in the case (1), the diameter-enlarged portion and the bending portion are provided at locations different from each other along the axis of intake passage 400, and the diameter-enlarged portion is located upstream beyond the bending portion. In the case (2), the diameter-enlarged portion and the bending portion are provided at locations different from each other along the axis of intake passage 400, and the diameter-enlarged portion is located downstream beyond the bending portion. In the case (3), the diameter-enlarged portion and the bending portion are integrally formed.

In the cases (1) and (2), the bending portion may bend while reducing its diameter as compared with that of the junction portion 400*c* or may bend without reducing its diameter, in order to obtain the gas-mixing effect. As a reason for this, even if the gas-mixing effect between fresh air and exhaust gas is insufficient at the bending portion due to the diameter reduction of this bending portion, the fresh air and the exhaust gas are sufficiently mixed with each other by the diameter-enlarged portion to compensate for such insufficiency. On the other hand, in the case (3), the intake passage 400 extends from the junction portion 400*c* while enlarging its inner diameter and while bending. In all the cases (1) to (3), the fresh air and the exhaust gas can be sufficiently mixed with each other, and moreover, a space saving and an easy handling of air intake system can be attained around the engine and in its surroundings, by the bending portion. Thus, the combined effect can be produced in all the cases (1) to (3) according to the present invention.

Figure 4:
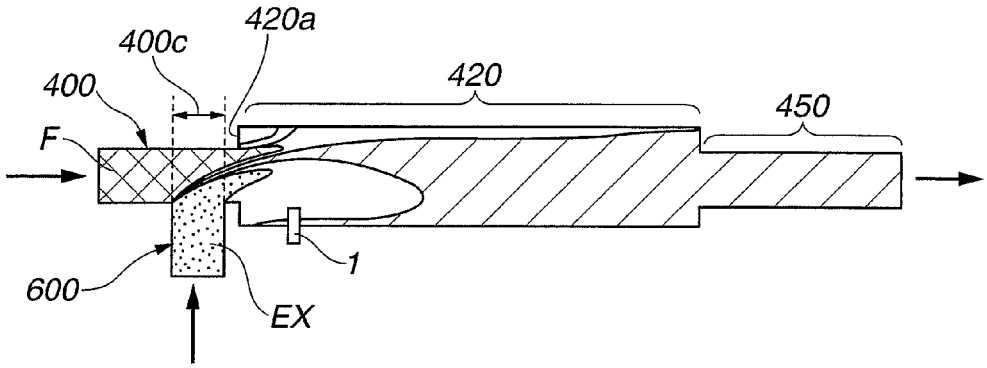
FIG. 4 is a view showing a mixing state of mixture gas in a case that a diameter of downstream side of the diameter-enlarged portion is reduced.

According to the present invention, a diameter-reduced portion 450 may be provided by reducing the diameter of a downstream portion of diameter-enlarged portion 420 of FIG. 2, as shown in FIG. 4. The gas sensor 1 may be disposed in the diameter-reduced portion 450, because the exhaust gas and the fresh gas have already been sufficiently mixed with each other inside the diameter-reduced portion 450 by virtue of the existence of diameter-enlarged portion 420. FIG. 4 shows a simulation result conducted under a condition identical with that of FIG. 10. In the case of FIG. 4, an inner diameter of diameter-reduced portion 450 is equal to 52 mm.

According to the present invention, a portion of intake passage 400 which is located downstream beyond the junction portion 400*c* may bend while enlarging its inner diameter (namely, both of the diameter-enlarged portion and the bending portion may be formed together). Moreover, the diameter-enlarged portion 420 and the bending portion 430 may be arranged in this order, or the bending portion 430 and the diameter-enlarged portion 420 may be arranged in this order, at a portion of intake passage 400 which is located on a downstream side of the junction portion 400*c*.

Moreover, a branch or bypass passage may be formed at a portion of intake passage 400 at which the gas sensor 1 is provided. However, a portion of diameter-enlarged portion 420 or bending portion 430 which is located upstream beyond this branch location (location of gas sensor 1) needs to be formed as one passage, i.e., needs to have no branch or bypass. This is because there is a possibility that the gas-mixing effect between fresh air and exhaust gas is damaged if the diameter-enlarged portion 420 or bending portion 430 branches.

Figure 5:
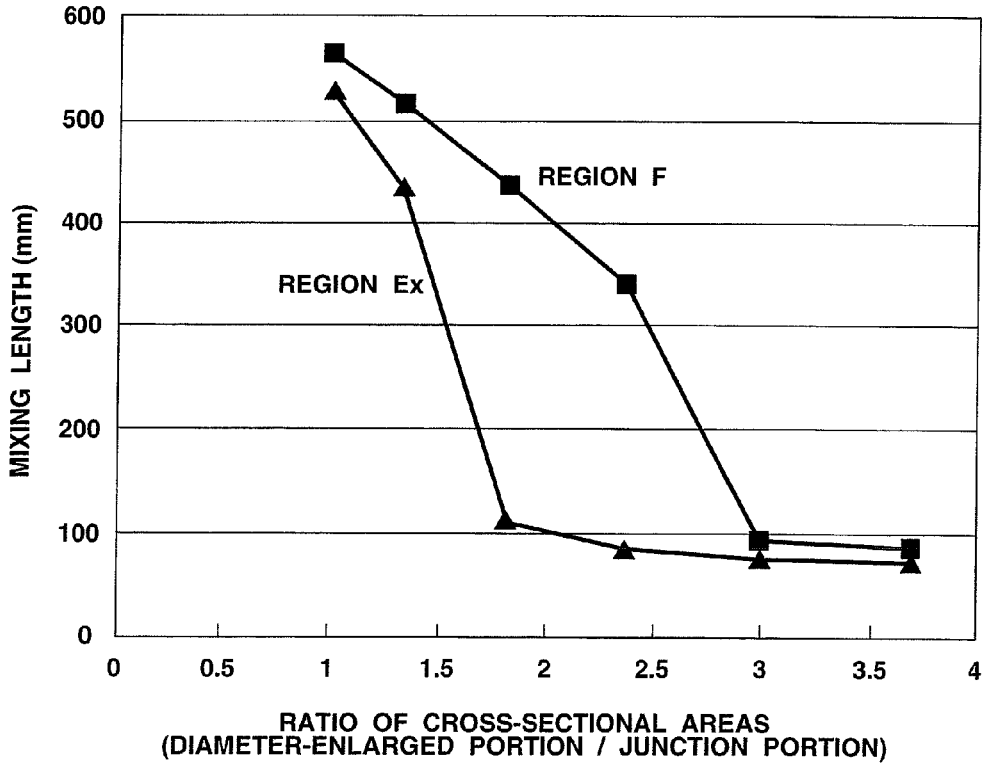
FIG. 5 is a view showing mixing lengths of fresh air and exhaust gas when a cross-sectional area of the diameter-enlarged portion is varied with respect to that of the junction portion.
Figure 6:
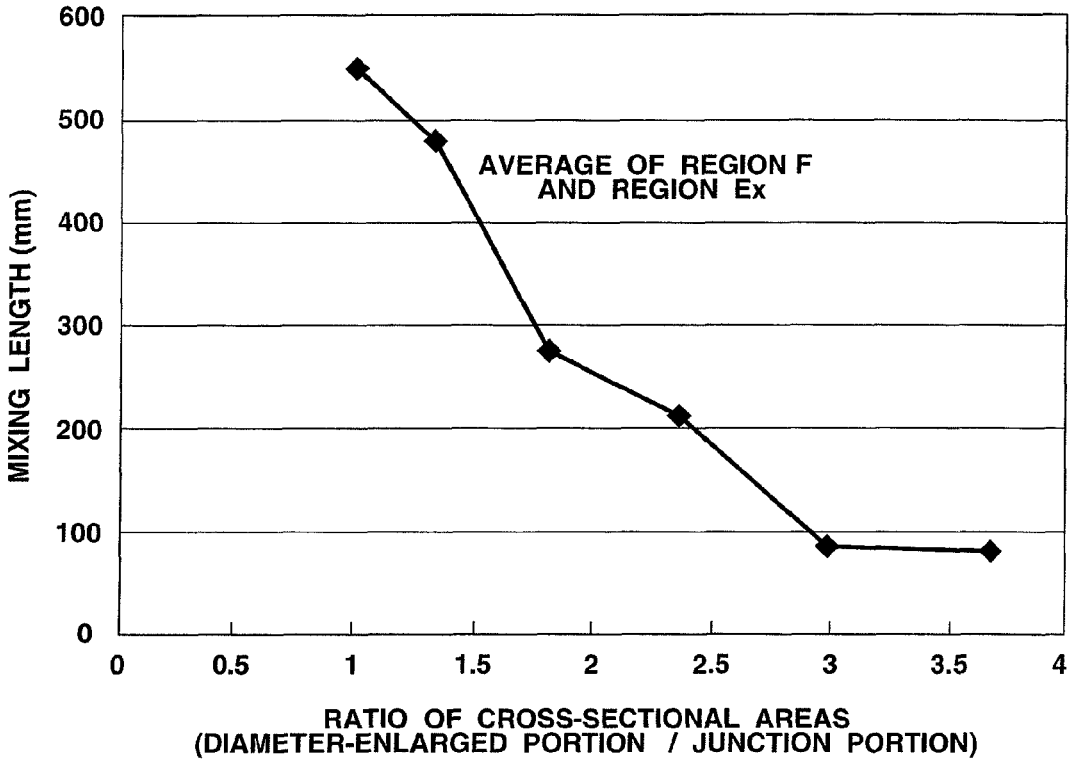
FIG. 6 is a view showing an average value (mean value) of the mixing lengths of fresh air and exhaust gas of FIG. 5.

Next, the mixing state between the fresh air and the exhaust gas when the cross-sectional area of diameter-enlarged portion 420 is varied with respect to that of junction portion 400*c* will now be explained referring to FIGS. 5 and 6. FIGS. 5 and 6 show simulation results conducted under the condition identical with that of FIG. 2. In the case of FIGS. 5 and 6, the diameter-enlarged portion 420 is connected to the downstream side of junction portion 400*c*, and the inner diameter of diameter-enlarged portion 420 is varied between 52 mm and 100 mm. Moreover, all portions of intake passage 400 except the diameter-enlarged portion 420 have the uniform magnitude of inner diameter (equal to 52 mm). The junction portion 400*c* also has the uniform magnitude of inner diameter equal to 52 mm. A distance between the upstream end 420*a* (location point $T_4$) of diameter-enlarged portion 420 and the center (location point $T_1$) between upstream and downstream ends of junction portion 400*c* is equal to 40 mm. FIG. 5 is a view showing a mixing length of the region F and a mixing length of the region Ex with respect to a ratio of cross-sectional areas (opening area S1 of diameter-enlarged portion 420/opening area S2 of junction portion 400*c*). These mixing length of region F and mixing length of region Ex are calculated after obtaining the mixing state of simulation as a distribution of respective regions in the same manner as FIG. 2. For example, the mixing length of region F is a distance from the center location $T_1$ between upstream and downstream ends of junction portion 400*c* to a location (location point $T_2$ in FIG. 2) up to which the region F extends in the axial direction of diameter-enlarged portion 420. That is, the location point $T_2$ is an end of the region F in the axial downstream direction. Similarly, the mixing length of region Ex is a distance from the center location $T_1$ between upstream and downstream ends of junction portion 400*c* to a location (location point $T_3$ in FIG. 2) up to which the region Ex extends in the axial direction of diameter-enlarged portion 420. That is, the location point $T_3$ is an end of the region Ex in the axial downstream direction. The (sufficient) mixing is attained at a downstream point closer to the junction portion 400*c* as the mixing length becomes smaller.

As shown in FIG. 5, both of the mixing length of region F and the mixing length of region Ex become small when the ratio of cross-sectional areas is greater than 1.0.

It is preferable that a formula: $L1 \geq -439 \times (S1/S2)^2 + 871 \times (S1/S2) + 151$ is satisfied (unit: mm) in a case where the ratio S1/S2 of cross-sectional areas is lower than 2. Wherein L1 denotes a distance between the attachment point $T_5$ of gas sensor 1 and the center point $T_1$ between upstream and downstream ends of junction portion 400*c*. In a case where the ratio S1/S2 of cross-sectional areas is greater than or equal to 2, it is preferable that a formula: $L1 \geq 100$ mm is satisfied. By attaching the gas sensor 1 at such locations, the gas sensor 1 can be exposed to the mixture gas of fresh air and exhaust gas which have been sufficiently mixed with each other (in particular, region Ex has been sufficiently mixed) by the diameter-enlarged portion 420. Therefore, the concentration of specific gas component included in the mixture gas can be accurately detected.

Moreover, in a case where the ratio S1/S2 of cross-sectional areas is lower than 3, it is preferable that a formula: $L1 \geq -86 \times (S1/S2)^2 + 115 \times (S1/S2) + 525$ is satisfied. In a case where the ratio S1/S2 of cross-sectional areas is greater than or equal to 3, it is so preferable that a formula: $L1 \geq 100$ mm is satisfied. By attaching the gas sensor 1 at such locations, the gas sensor 1 can be exposed to the mixture gas of fresh air and exhaust gas which have been sufficiently mixed with each other (in particular, region F has been sufficiently mixed) by the diameter-enlarged portion 420. Therefore, the concentration of specific gas component included in the mixture gas can be accurately detected.

FIG. 6 is a view showing an average value of the mixing length of F region and the mixing length of region Ex, with respect to the ratio of cross-sectional areas. As shown in FIG. 6, when the ratio of cross-sectional areas is greater than or equal to 1.8, the mixing length can be reduced by half as compared with the case where the ratio of cross-sectional areas is equal to 1.0. Also as shown in FIG. 6, when the ratio of cross-sectional areas is greater than or equal to 3.0, the mixing length becomes sufficiently small so that exhaust gas and fresh air can be more sufficiently mixed with each other easily. Therefore, it is preferable that the ratio of cross-sectional areas (cross-sectional area of diameter-enlarged portion 420/cross-sectional area of junction portion 400*c*) is greater than or equal to 1.8, and it is further preferable that the ratio of cross-sectional areas is greater than or equal to 3.0.

Figure 9:
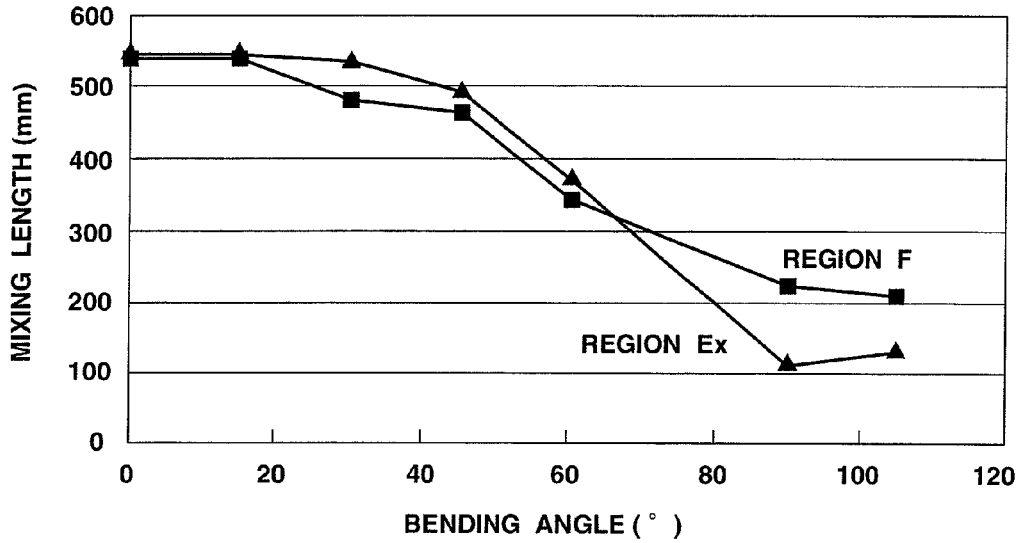
FIG. 9 is a view showing mixing lengths of fresh air and exhaust gas when a bending angle of bending portion is varied with respect to the junction portion with the EGR passage.

Next, the mixing state between the fresh air and the exhaust gas when a bending angle of the bending portion 430 is varied relative to (an axial direction of intake passage 400 taken at) the junction portion 400*c* will now be explained referring to FIG. 9. FIG. 9 is a graph showing a simulation result under the condition identical with that of FIG. 3. All portions of intake passage 400 including the junction portion 400*c* have an uniform magnitude of inner diameter (equal to 52 mm). The distance between the upstream end (location $T_9$) of bending portion 430 and the center (location $T_6$) between upstream and downstream ends of junction portion 400*c* is equal to 100 mm. FIG. 9 shows the mixing length of region F and the mixing length of region Ex with respect to the bending angle (°). These mixing length of region F and mixing length of region Ex are calculated after obtaining the mixing state of simulation as a distribution of respective regions in the same manner as FIG. 3. For example, the mixing length of region F is a distance from the center location $T_6$ between upstream and downstream ends of junction portion 400*c* to a location (location point $T_7$ in FIG. 3) up to which the region F extends along the axis of intake passage 400. That is, the location point $T_7$ is an end of the region F in the downstream direction. Similarly, the mixing length of region Ex is a distance from the center location $T_6$ between upstream and downstream ends of junction portion 400*c* to a location (location point $T_8$ in FIG. 3) up to which the region Ex extends along the axis of intake passage 400. That is, the location point $T_8$ is an end of the region Ex in the downstream direction. The sufficient mixing is attained at a downstream point closer to the junction portion 400*c* as the mixing length becomes smaller.

As shown in FIG. 9, it can be recognized that both of the mixing length of region F and the mixing length of region Ex become smaller when the bending angle is greater than 0° (i.e., in the case where the bending portion 430 is provided).

Moreover, it is preferable that a formula: $L2 \geq -0.075(R1)^2+1.8R1+545$ is satisfied in a case where R1 is smaller than 90 degrees. Wherein R1 denotes the bending angle of bending portion 430, and L2 denotes a distance between the attachment point $T_{10}$ of gas sensor 1 and the center point $T_6$ between upstream and downstream ends of junction portion 400*c*. In a case where R1 is greater than or equal to 90 degrees, it is preferable that a formula: $L2 \geq 100$ mm is satisfied. By attaching the gas sensor 1 at such locations, the gas sensor 1 can be exposed to the mixture gas of fresh air and exhaust gas which have been sufficiently mixed with each other (in particular, region Ex has been sufficiently mixed) by the bending portion 430. Therefore, the concentration of specific gas component included in the mixture gas can be accurately detected.

Moreover, in the case where R1 is smaller than 90 degrees, it is preferable that a formula: $L2 \geq -0.027(R1)^2-1.4R1+560$ is satisfied. In the case where R1 is greater than or equal to 90 degrees, it is more preferable that a formula: $L2 \geq 200$ mm is satisfied. By attaching the gas sensor 1 at such locations, the gas sensor 1 can be exposed to the mixture gas of fresh air and exhaust gas which have been sufficiently mixed with each other (in particular, region F has been sufficiently mixed) by the bending portion 430. Therefore, the concentration of specific gas component included in the mixture gas can be so accurately detected.

As mentioned above, the diameter-enlarged portion 420 having an inner diameter larger than the inner diameter of junction portion 400*c* or the bending portion 430 bending without reducing its inner diameter as compared with the inner diameter of junction portion 400*c* is formed at a portion of intake passage 400 which is located on the downstream side of the junction portion 400*c*. Then, the gas sensor 1 is attached to a portion of intake passage 400 which is located downstream from the diameter-enlarged portion 420 or the bending portion 430. Accordingly, since the intake air (fresh air) passing within the intake passage 400 is sufficiently mixed with the exhaust gas supplied from the junction portion 400*c*, the concentration of specific gas included in the mixture gas can be accurately detected to improve the performance of internal combustion engine.

Some Features and Effects in Summary

According to the embodiments of the present invention, the air intake system for the internal combustion engine 300 includes the intake passage 400 connected with the intake ports 302*a* of internal combustion engine 300; the EGR passage 600 merged with the intake passage 400 at the junction portion 400*c*; the gas sensor 1 attached to the intake passage 400 and configured to detect the concentration of specific gas; and the control section 800 configured to control the internal combustion engine 300 on the basis of the output signal of gas sensor 1. Moreover, the diameter-enlarged portion 420 having an inner so diameter larger than that of the junction portion 400*c* is formed at a portion of the intake passage 400 which is located on a downstream side of the junction portion 400*c*, and the gas sensor 1 is located downstream from the diameter-enlarged portion 420. Accordingly, the intake air (fresh air) flowing inside the intake passage 400 is sufficiently mixed with the exhaust gas flowing from the EGR passage 600 through the junction portion 400*c* into the intake passage 400, downstream from the diameter-enlarged portion 420. By attaching the gas sensor 1 to such locations, the concentration of specific gas included in the mixture gas can be accurately detected to enhance the performance of internal combustion engine 300. The gas sensor 1 has only to be attached to a portion of intake passage 400 which is located downstream from the diameter-enlarged portion 420, namely, the gas sensor 1 may be disposed in the diameter-enlarged portion 420 or may be disposed at a portion of intake passage 400 which is located downstream beyond the diameter-enlarged portion 420 (for example, may be disposed in the diameter-reduced portion 450 having its inner diameter smaller than that of diameter-enlarged portion 420).

According to the embodiments of the present invention, it is preferable that the distance between the upstream end 420*a* of diameter-enlarged portion 420 and the center $T_1$ between upstream and downstream ends of the junction portion 400*c* is smaller than or equal to 510 mm. In this case, the fresh air and the exhaust gas can be more quickly introduced to the diameter-enlarged portion 420, so that the fresh air and the exhaust gas can be sufficiently mixed with each other from a location closer to the junction portion 400*c*. Thereby, the gas sensor 1 can be attached to a location closer to the junction portion 400*c*. The diameter-enlarged portion 420 may be provided away from the junction portion 400*c*, or may be formed in a continuous manner from the junction portion 400*c* (i.e., the diameter-enlarged portion 420 may start from an end of junction portion 400*c*).

According to the embodiments of the present invention, it is preferable that the formula: $L1 \geq -439\times(S1/S2)^2+871\times(S1/S2)+151$ is satisfied in the case that the relation: $S1/S2<2$ is satisfied, and the formula: $L1 \geq 100$ is satisfied in the case that the relation: $S1/S2 \geq 2$ is satisfied, wherein S1 denotes the opening area of diameter-enlarged portion 420, S2 denotes the opening area of junction portion 400*c*, and L1 denotes the distance between the center $T_1$ of junction portion 400*c* and the attachment location $T_5$ of gas sensor 1 (unit: mm). By disposing the gas sensor 1 in such a manner, the gas sensor 1 can be exposed to the mixture gas in which the exhaust gas has been sufficiently mixed by the diameter-enlarged portion 420. Therefore, the concentration of specific gas component can be accurately detected in the mixture gas. The above-mentioned distance between the attachment location of gas sensor 1 and the center of upstream and downstream ends of junction portion 400*c* is defined by a length taken along the axis of intake passage (pipe) 400. For example, in a case that the intake passage (pipe) is curved (or bent), the above-mentioned distance between the attachment location of gas sensor 1 and the center of upstream and downstream ends of junction portion 400*c* means a length of imaginary straight line obtained by straightening the axis of the curved intake passage, between the attachment location of gas sensor 1 and the center of upstream and downstream ends of junction portion 400*c*.

According to the embodiments of the present invention, it is further preferable that the formula: $L1 \geq -86\times(S1/S2)^2+115\times(S1/S2)+525$ is satisfied in the case that the relation: $S1/S2<3$ is satisfied, and the formula: $L1 \geq 100$ is satisfied in the case that the relation: $S1/S2 \geq 3$ is satisfied, wherein S1 denotes the opening area of diameter-enlarged portion 420, S2 denotes the opening area of junction portion 400*c*, and L1 denotes the distance between the center $T_1$ of junction portion 400*c* and the attachment location $T_5$ of gas sensor 1 (unit: mm). By disposing the gas sensor 1 in such a manner, the gas sensor 1 can be exposed to the mixture gas in which the fresh air has been sufficiently mixed by the diameter-enlarged portion 420. Therefore, the concentration of specific gas component can be detected in the mixture gas more accurately.

According to the embodiments of the present invention, the bending portion 430 bending relative to the axial direction of intake passage 400 taken at the junction portion 400*c* may be formed at a portion of intake passage 400 which is located on the downstream side of junction portion 400*c*, in addition to the diameter-enlarged portion 420. Then, the gas sensor 1 may be located downstream from the bending portion 430. Accordingly, the gas-mixing effect between intake air (fresh air) and exhaust gas is further improved by the bending portion 430. Hence, the concentration of specific gas component included in the mixture gas can be detected further accurately by the gas sensor 1 arranged downstream from these diameter-enlarged portion 420 and bending portion 430. Therefore, the performance of internal combustion engine can be further improved.

According to the embodiments of the present invention, the air intake system for the internal combustion engine 300 includes the intake passage 400 connected with the intake ports 302*a* of internal combustion engine 300; the EGR passage 600 merged with the intake passage 400 at the junction portion 400*c*; the gas sensor 1 attached to the intake passage 400 and configured to detect the concentration of specific gas; and the control section 800 configured to control the internal combustion engine 300 on the basis of the output signal of gas sensor 1. Moreover, the bending portion 430 bending without reducing its inner diameter as compared with the inner diameter of junction portion 400*c* is formed at a portion of the intake passage 400 which is located on the downstream side of the junction portion 400*c*, and the gas sensor 1 is located downstream from the bending portion 430. Accordingly, the intake air (fresh air) which flows inside the intake passage 400 is sufficiently mixed with the exhaust gas which flows from the EGR passage 600 through the junction portion 400*c* into the intake passage 400, downstream from the bending portion 430. By attaching the gas sensor 1 to such locations, the concentration of specific gas included in the mixture gas can be accurately detected to enhance the performance of internal combustion engine 300.

According to the embodiments of the present invention, it is preferable that the distance between the upstream end $T_9$ of bending portion 430 and the center $T_6$ between upstream and downstream ends of junction portion 400*c* is smaller than or equal to 510 mm. In this case, the fresh air and the exhaust gas can be more quickly introduced to the bending portion 430, so that the fresh air and the exhaust gas can be sufficiently mixed with each other from a location closer to the junction portion 400*c*. Thereby, the gas sensor 1 can be attached to a location closer to the junction portion 400*c*. The bending portion 430 may be provided away from the junction portion 400*c*, or may be formed in a continuous manner from the junction portion 400*c* (i.e., may start from an end of junction portion 400*c*).

According to the embodiments of the present invention, it is preferable that the formula: $L2 \geq -0.075(R1)^2+1.8R1+545$ is satisfied in the case that R1 is smaller than 90 degrees, and the formula: $L2 \geq 100$ is satisfied in the case that R1 is greater than or equal to 90 degrees, wherein R1 denotes the bending angle of bending portion 430, and L2 denotes the distance between the center $T_6$ of junction portion 400*c* and the attachment location $T_{10}$ of gas sensor 1 (unit: mm). By attaching the gas sensor 1 to such locations, the gas sensor 1 can be exposed to the mixture gas in which the exhaust gas has been sufficiently mixed by the bending portion 430. Therefore, the concentration of specific gas component can be accurately detected in the mixture gas. The above-mentioned distance between the attachment location of gas sensor 1 and the center of upstream and downstream ends of junction portion 400*c* is defined by a length taken along the axis of intake passage (pipe) 400. For example, in the case that the intake passage (pipe) is bent, the above-mentioned distance between the attachment location of gas sensor 1 and the center of upstream and downstream ends of junction portion 400*c* means a length of imaginary straight line obtained by straightening the axis of the bent intake passage, between the attachment location of gas sensor 1 and the center of upstream and downstream ends of junction portion 400*c*.

According to the embodiments of the present invention, it is further preferable that the formula: $L2 \geq -0.027\ (R1)^2-1.4R1+560$ is satisfied in the case that R1 is smaller than 90 degrees, and the formula: $L2 \geq 200$ is satisfied in the case that R1 is greater than or equal to 90 degrees, wherein R1 denotes the bending angle of the bending portion 430, and L2 denotes the distance between the center $T_6$ of junction portion 400*c* and the attachment location $T_{10}$ of gas sensor 1 (unit: mm). By attaching the gas sensor 1 to such locations, the gas sensor 1 can be exposed to the mixture gas in which the fresh air has been sufficiently mixed by the bending portion 430. Therefore, the concentration of specific gas can be detected in the mixture gas, more accurately.

Although the invention has been described above with reference to certain embodiments of the invention, the invention is not limited to the embodiments described above. Modifications and variations of the embodiments described above will occur to those skilled in the art in light of the above teachings. For example, as the specific gas component which is detected in order to control the internal combustion engine, oxygen, NOx or the like can be used. Moreover, as the gas sensor 1, an oxygen sensor (λ sensor), an air-fuel ratio sensor or the like can be used. Moreover, shape and size of each of the intake passage, the EGR passage, the junction portion, the diameter-enlarged portion and the like are not limited, but for example, can be formed in a shape of cylindrical tube. Furthermore, the internal combustion engine is not limited to the diesel engine, but may be a gasoline engine.

This application is based on prior Japanese Patent Application No. 2009-142033 filed on Jun. 15, 2009. The entire contents of this Japanese Patent Application are hereby incorporated by reference.

The scope of the invention is defined with reference to the following claims.

What is claimed is:

1. An intake system for an internal combustion engine, comprising:

an intake passage connected with an intake port of the internal combustion engine;

an EGR passage merged with the intake passage at a junction portion;

a gas sensor attached to the intake passage and configured to detect a concentration of specific gas; and a control section configured to control the internal combustion engine on the basis of an output signal of the gas sensor, wherein a diameter-enlarged portion having an inner diameter larger than an inner diameter of the junction portion is formed at a portion of the intake passage which is located on a downstream side of the junction portion, wherein the gas sensor is located downstream from an upstream end of the diameter-enlarged portion, wherein a distance between an upstream end of the diameter-enlarged portion and a center between upstream and downstream ends of the junction portion is smaller than or equal to 510 mm, and wherein a formula: $L1 \geq -439\times(S1/S2)^2+871\times(S1/S2)+151$ is satisfied in a case that a relation: $S1/S2<2$ is satisfied, and a formula: $L1 \geq 100$ is satisfied in a case that a relation: $S1/S2 \geq 2$ is satisfied, wherein S1 denotes an opening area of the diameter-enlarged portion, S2 denotes an opening area of the junction portion, and L1 denotes a distance between the center of the junction portion and an attachment location of the gas sensor (unit: mm).

2. An intake system for an internal combustion engine, comprising:

an intake passage connected with an intake port of the internal combustion engine;

an EGR passage merged with the intake passage at a junction portion;

a gas sensor attached to the intake passage and configured to detect a concentration of specific gas; and a control section configured to control the internal combustion engine on the basis of an output signal of the gas sensor, wherein a diameter-enlarged portion having an inner diameter larger than an inner diameter of the junction portion is formed at a portion of the intake passage which is located on a downstream side of the junction portion, wherein the gas sensor is located downstream from an upstream end of the diameter-enlarged portion, wherein a distance between an upstream end of the diameter-enlarged portion and a center between upstream and downstream ends of the junction portion is smaller than or equal to 510 mm, and wherein a formula: $L1 \geq -86 \times (S1/S2)^2 + 115 \times (S1/S2) + 525$ is satisfied in a case that a relation: $S1/S2 < 3$ is satisfied, and a formula: $L1 \geq 100$ is satisfied in a case that a relation: $S1/S2 \geq 3$ is satisfied, wherein S1 denotes an opening area of the diameter-enlarged portion, S2 denotes an opening area of the junction portion, and L1 denotes a distance between the center of the junction portion and an attachment location of the gas sensor (unit: mm).

3. An intake system for an internal combustion engine, comprising:

an intake passage connected with an intake port of the internal combustion engine;

an EGR passage merged with the intake passage at a junction portion;

a gas sensor attached to the intake passage and configured to detect a concentration of specific gas; and a control section configured to control the internal combustion engine on the basis of an output signal of the gas sensor, wherein a diameter-enlarged portion having an inner diameter larger than an inner diameter of the junction portion is formed at a portion of the intake passage which is located on a downstream side of the junction portion, wherein the gas sensor is located downstream from an upstream end of the diameter-enlarged portion, and wherein a bending portion bending relative to the junction portion is formed at a portion of the intake passage which is located on a downstream side of the junction portion, and the gas sensor is located downstream from the bending portion.

4. An intake system for an internal combustion engine, comprising:

an intake passage connected with an intake port of the internal combustion engine;

an EGR passage merged with the intake passage at a junction portion;

a gas sensor attached to the intake passage and configured to detect a concentration of specific gas; and a control section configured to control the internal combustion engine on the basis of an output signal of the gas sensor, wherein a bending portion bending without reducing its inner diameter as compared with an inner diameter of the junction portion is formed at a portion of the intake passage which is located on a downstream side of the junction portion, wherein the gas sensor is located downstream from the bending portion, wherein a distance between an upstream end of the bending portion and a center between upstream and downstream ends of the junction portion is smaller than or equal to 510 mm, and wherein a formula: $L2 \geq -0.075(R1)^2 + 1.8R1 + 545$ is satisfied in a case that R1 is smaller than 90 degrees, and a formula: $L2 \geq 100$ is satisfied in a case that R1 is greater than or equal to 90 degrees, wherein R1 denotes a bending angle of the bending portion, and L2 denotes a distance between the center of the junction portion and an attachment location of the gas sensor (unit: mm).

5. The intake system as claimed in claim 4, wherein a formula: $L2 \geq -0.027\ (R1)^2 - 1.4R1 + 560$ is satisfied in a case that R1 is smaller than 90 degrees, and a formula: $L2 \geq 200$ is satisfied in a case that R1 is greater than or equal to 90 degrees.

* * * * *